United States Patent [19]

Beck

[11] Patent Number: 4,795,956

[45] Date of Patent: Jan. 3, 1989

[54] WEB MOTION CONVERTER

[75] Inventor: Thomas L. Beck, Union Grove, Wis.

[73] Assignee: Unico, Inc., Franksville, Wis.

[21] Appl. No.: 94,985

[22] Filed: Sep. 10, 1987

[51] Int. Cl.[4] ..... G05B 11/01

[52] U.S. Cl. ..... 318/628; 318/135; 318/593; 318/6; 198/805; 364/469

[58] Field of Search ..... 318/628, 617, 135, 593; 198/805; 364/469

[56] References Cited

U.S. PATENT DOCUMENTS

| | | | |
|---|---|---|---|
| 2,684,753 | 7/1954 | Kolbe et al. | 198/805 |
| 3,890,547 | 6/1975 | Keck | 318/6 |
| 3,983,467 | 9/1976 | Borrons et al. | 318/593 |
| 4,704,568 | 11/1987 | Beck et al. | 318/687 |

*Primary Examiner*—William M. Shoop, Jr.

*Assistant Examiner*—Saul M. Bergmann

*Attorney, Agent, or Firm*—Quarles & Brady

[57] ABSTRACT

A motion converter is disposed at the input to a work station to convert the constant velocity of sheet material as it is payed out from a roll into a cyclic, stop and go motion. The motion converter includes a pair of actuators containing electromagnets and these are alternately energized to attract the sheet material first against a contoured surface and then a flat surface. Sheet material accumulates in a serpentine path within the motion converter when attracted toward the contoured surface and it is expelled rapidly therefrom when attracted toward the flat surface. A programmed position control operates the electromagnets in response to position feedback signals from sensors on the motion converter.

6 Claims, 7 Drawing Sheets

WEB MOTION CONVERTER

BACKGROUND OF THE INVENTION

The field of the invention is motor drives for positioning materials at a work station and, particularly, the movement and positioning of metal during high speed manufacturing processes.

Many articles are formed from sheets of metal which are cut and shaped in high speed automated manufacturing processes. For example, sheet steel may be removed from a roll, cut into pieces, and formed into automobile fenders, refrigerator doors, or the like, at a rate of fifty or sixty per minute. The movement of the metal fabricating material is accomplished using rollers or belts which are driven by conventional a.c. or d.c. rotary electric motors. The rotary motors drive the rollers or belts through a mechanical drive train which may include shafts and gears of various sizes and shapes. The rotary motors are controlled by drive circuits which determine the direction and speed of rotation. Feedback devices such as pulse generators may also be employed with such drive circuits to form closed loop position controls that enable the system to rapidly move the fabricating material and precisely position it in a workstation.

There are a number of difficulties with conventional motor drive systems for high speed metal fabricating processes. First, the rollers or belts employed to propel the fabricating material can mar the surface of the material. This is a major problem when soft metals are used, or when the fabricating material is subjected to high acceleration and deceleration forces. To minimize such problems, the surface area of the driving elements is often increased to distribute the driving force over the surface of the fabricating material. This requires larger, or additional rollers, which in turn increases the size of the drive train from the rotary motors. The mass of the drive train and rollers may exceed that of the driven fabricating material. As a result, the drive motor and its control circuits must be substantially increased in size to meet the desired acceleration and deceleration specifications.

As disclosed in U.S. Pat. No. 4,491,777, most of these difficulties are overcome by the use of a position control system which employs a linear motor to move the sheet material. The sheet material becomes part of the linear motor and is moved with respect to the stationary motor windings with little or no physical contact. The sheet material may thus be moved quickly into a work position without marring its surfaces or without the need for large drive rollers.

Because metal fabricating operations are typically performed when the sheet material is stationary, the sheet feeding control system must continously accelerate and decelerate the material being fed into the work station. On the other hand, the sheet material is typically stored as a large roll which is payed out at a relatively constant rate. As a result, apparatus must be provided for converting the relatively constant feedrate from the roll into the cyclic, stop and go motion into the work station. Traditionally, this conversion has been achieved by providing a loop of sheet material in which material is input at a constant feedrate and removed in a cyclic pattern. The loop is defined by a series of rollers, which on the output side are accelerated and decelerated along with the sheet material. While these need not necessarily be drive rollers if the linear motor drive of the above-cited patent is employed, they still have inertia and can mar the surface of the sheet material.

SUMMARY OF THE INVENTION

The present invention relates to a motion converter for sheet material in which the sheet material is input at a relatively constant feedrate and is output at a cyclic, variable feedrate. More specifically, the motion converter of the present invention includes upper and lower actuator elements which provide an input, an output, and a feedpath therebetween for the sheet material, the surface of one of the actuator elements is contoured to enable sheet material to flow through the feedpath in a serpentine path when the sheet material follows the contour of said one actuator element, and the surface of the other actuator element is shaped to enable sheet material to flow through the feedpath in a substantially straight line. A control system is connected to the actuator elements and is operable to cyclically energize said one actuator element such that the sheet material is attracted to it and accumulates sheet material in the serpentine path, and to cyclically deenergize the one actuator to enable accumulated sheet material to exit the output.

A general object of the invention is to convert relatively constant input of sheet material from a supply roll into cyclic motion for input to a machining station. When the actuator is energized, the sheet material which is input to the motion converter accumulates therein and the sheet material at the converter output slows or comes to a halt. A machining operation may then be performed. Following the machining operation, the actuator is deenergized and the accumulated sheet material is withdrawn rapidly from the output in preparation for the next cycle. The converter thus alternately accumulates and expels sheet material to convert the steady input feedrate into a pulsatile output feedrate.

Another object of the invention is to position the sheet material in the work station. The second actuator in the motion converter may also be energized by the control system to attract the sheet material toward its straight line feedpath and to thus provide a driving force which expels accumulated sheet material from the motion converter and moves it into the work station. Position sensing devices are employed to provide feedback information to the control system which enables it to energize and deenergize the actuators at a rate and for a duration which causes the desired amount of sheet material to be fed into the work station during each cycle.

A more specific object of the invention is to cyclically feed sheet material to a work station without marring the surfaces of the sheet material. The actuators need not contact the sheet material in order to perform their function. Their surfaces can be smooth and coated with a low friction material, and air bearings may be provided to eliminate physical contact with the sheet material.

The foregoing and other objects and advantages of the invention will appear from the following description. In the description, reference is made to the accompanying drawings which form a part hereof, and in which there is shown by way of illustration a preferred embodiment of the invention. Such embodiment does not necessarily represent the full scope of the invention, however, and reference is made therefore to the claims herein for interpreting the scope of the invention.

DESCRIPTION OF THE PREFERRED EMBODIMENT

Figure 1:
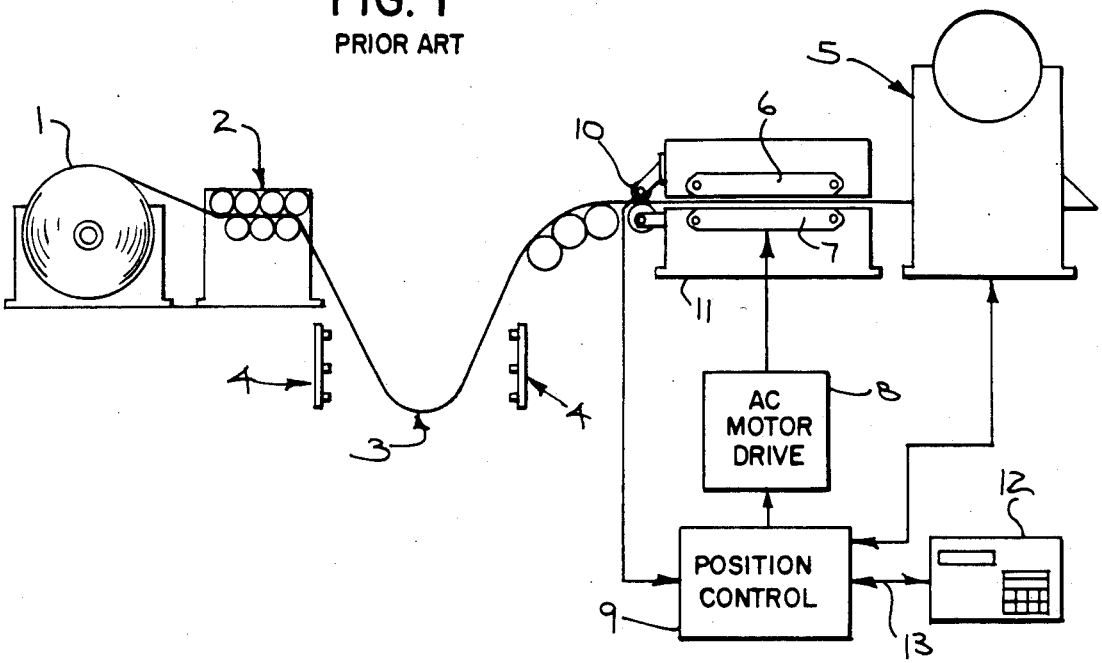
FIG. 1 PRIOR ART
FIG. 1 is a schematic diagram of a prior art system for feeding sheet material from a roll into a work station.

Referring particularly to FIG. 1, in prior systems the sheet material is in a roll 1 and is payed off to a series of rollers 2 which operate as a straightener. The sheet material 1 is electrically conductive and is typically steel. The sheet material 1 is payed off at a relatively constant rate and it is allowed to accumulate in a loop 3. Photosensors 4 operate to provide feedback signals to a motor drive system (not shown in the drawings) which controls the rate at which the sheet material 1 is payed off the roll.

A work station 5 receives the sheet material 1 and performs an operation on the material. Typical machines include presses, blankers and shears in which a preselected amount of sheet material 1 is rapidly transferred into the work station 5, decelerated to a stationary position, operated upon, and transferred on to the next work station (not shown in the drawings). To provide the driving force which moves the sheet material 1 into the work station 5, a pair of flat linear motors 6 and 7 are mounted adjacent the input side of the work station 5. An a.c. motor drive 8 supplies current to the linear motors 6 and 7 which interacts with the currents induced in the sheet material 1 to provide a driving force. By controlling the phase order and the magnitude of the currents applied to the linear motors 6 and 7, the position, velocity, acceleration and jerk of the sheet material 1 can be precisely controlled. A position control circuit 9 receives position feedback information from a pulse generator 10 that is mechanically mounted to the framework 11 which supports the linear motors 6 and 7. A programming panel 12 also connects to the position control 9 through a serial link 13, and using this panel 12, the position control 9 is programmed by an operator to move the sheet material 1 into the work station 5 a preselected distance and then operate the machine 5. For a more detailed description of this prior system, reference is made to U.S. Pat. No. 4,491,777.

It should be apparent that although the above described system is a substantial improvement over earlier systems which employed motor driven rollers to propel the sheet material 1 into the work station 5, guide rollers are still required at the output of the loop 3. In addition, the linear motors 6 and 7 must lift sheet material 1 from the loop 3 when accelerating the material into the work station 5 and this requires considerable power.

Figure 2:
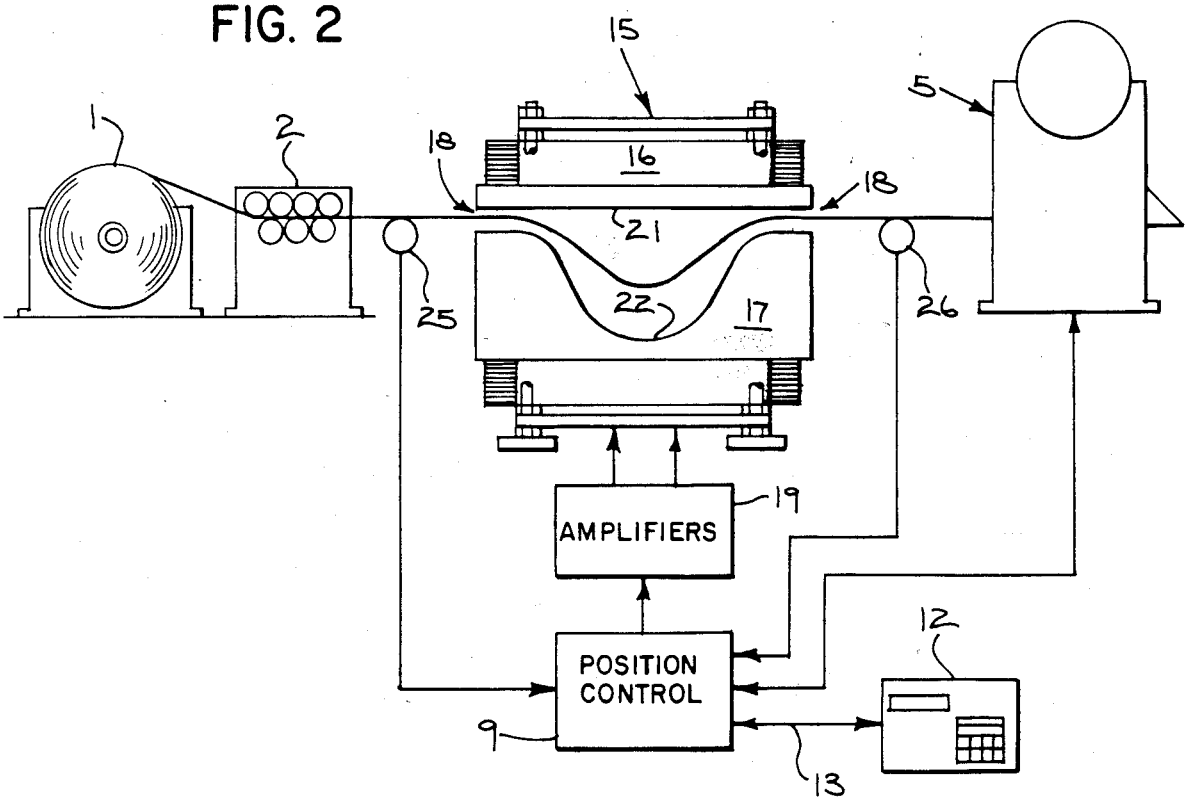
FIG. 2 is a schematic diagram of a system for feeding sheet material from a roll into a work station which employs the motion converter of the present invention.

Referring particularly to FIG. 2, the motion converter of the present invention replaces both the loop 3 and drive motors 6 and 7 in the prior art system. The motion converter is shown at 15 and it includes an upper actuator section 16 and a lower actuator section 17 which define between them a feedpath 18 through which the sheet material 1 passes. The actuatoss 16 and 17 are electromagnets that are separately energized by amplifiers 19 that are driven by the position control 9. The upper actuator 16 has a relatively flat bottom surface 21, and when energized, the sheet material 1 is attracted to this surface 21 and it assumes a substantially straight path through the feedpath 18. The lower actuato 17, on the other hand, has a contoured, serpentine, upper surface 22, and when the lower actuator 17 is energized, the sheet material 1 is attracted to it and assumes a serpentine shape. As a result, sheet material 1 which is fed into the motion converter 15 at a relatively constant feedrate accumulates in this serpentine path as it is drawn toward the contoured surface 22. The accumulated sheet material 1 is then expelled from the converter 15 to the work station 5 when the upper actuator 16 is energized and the sheet material is straightened against the surface 21. By alternately energizing the upper and lower actuators 16 and 17, therefore, the constant rate at which the sheet material is payed out from the roll 1 is converted to a pulsatile, feedrate at the work station 5.

The precise manner in which the motion converter 15 is operated is determined by the position control 9. The control 9 receives feedback signals from an incremental position feedback device 25 located at the input to the motion converter 15, and a second incremental position feedback device 26 located at its output. The feedback devices 25 and 26 engage the sheet material 1 as it passes by, and they produce a pulse train from which position, velocity and acceleration of the sheet material can be determined as it enters and exits the motion converter 15. The position control 9 operates in response to these feedback signals and a stored control program to enable the amplifiers 19 to alternately energize the upper and lower actuators 16 and 17. The position control 9 also outputs a signal to the work station 5 which synchronizes its operation with that of the motion converter 15.

Figure 3A:
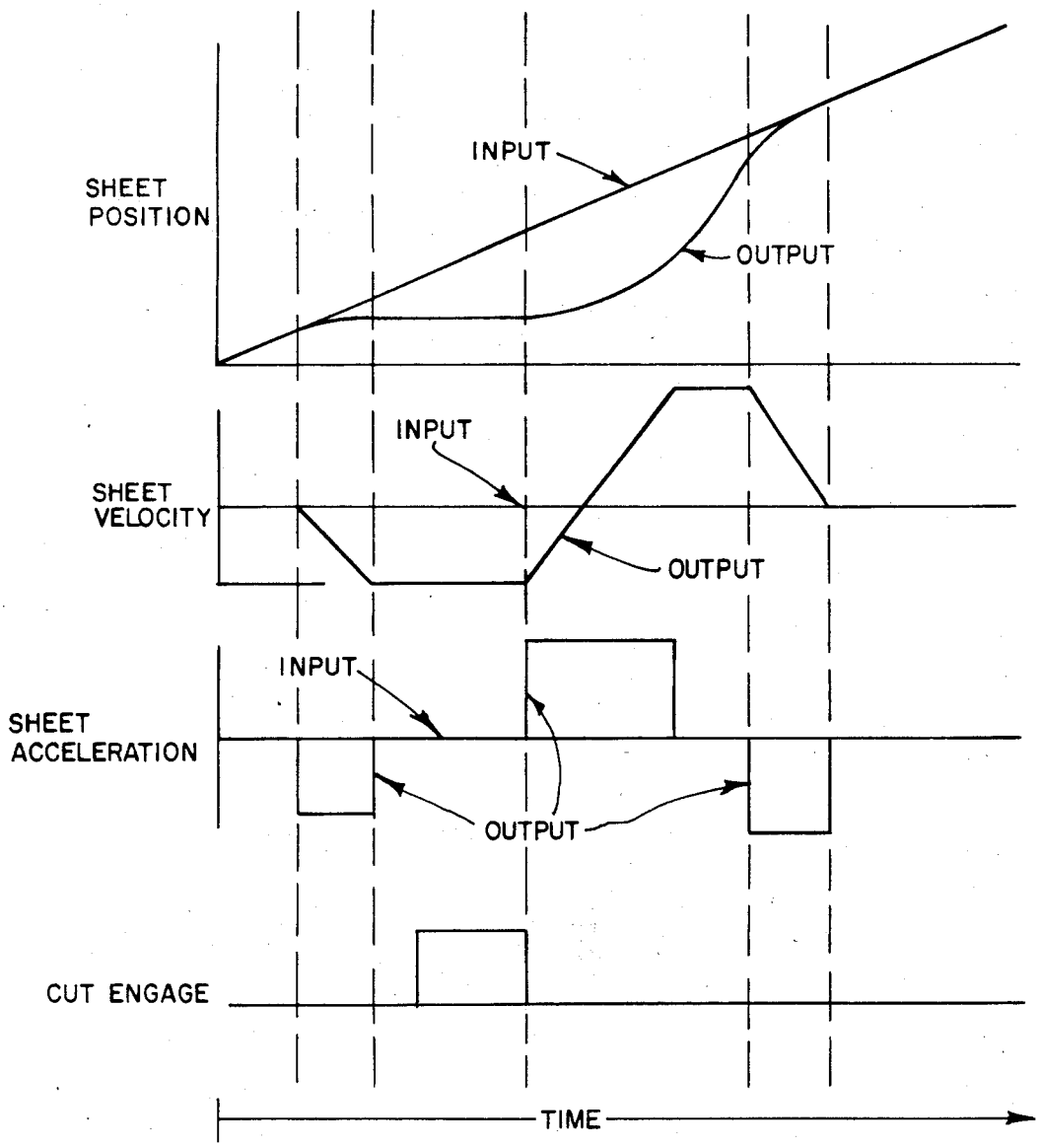
FIGS. 3A–3C are timing diagrams which illustrate three ways in which the motion converter may be operated.
Figure 3B:
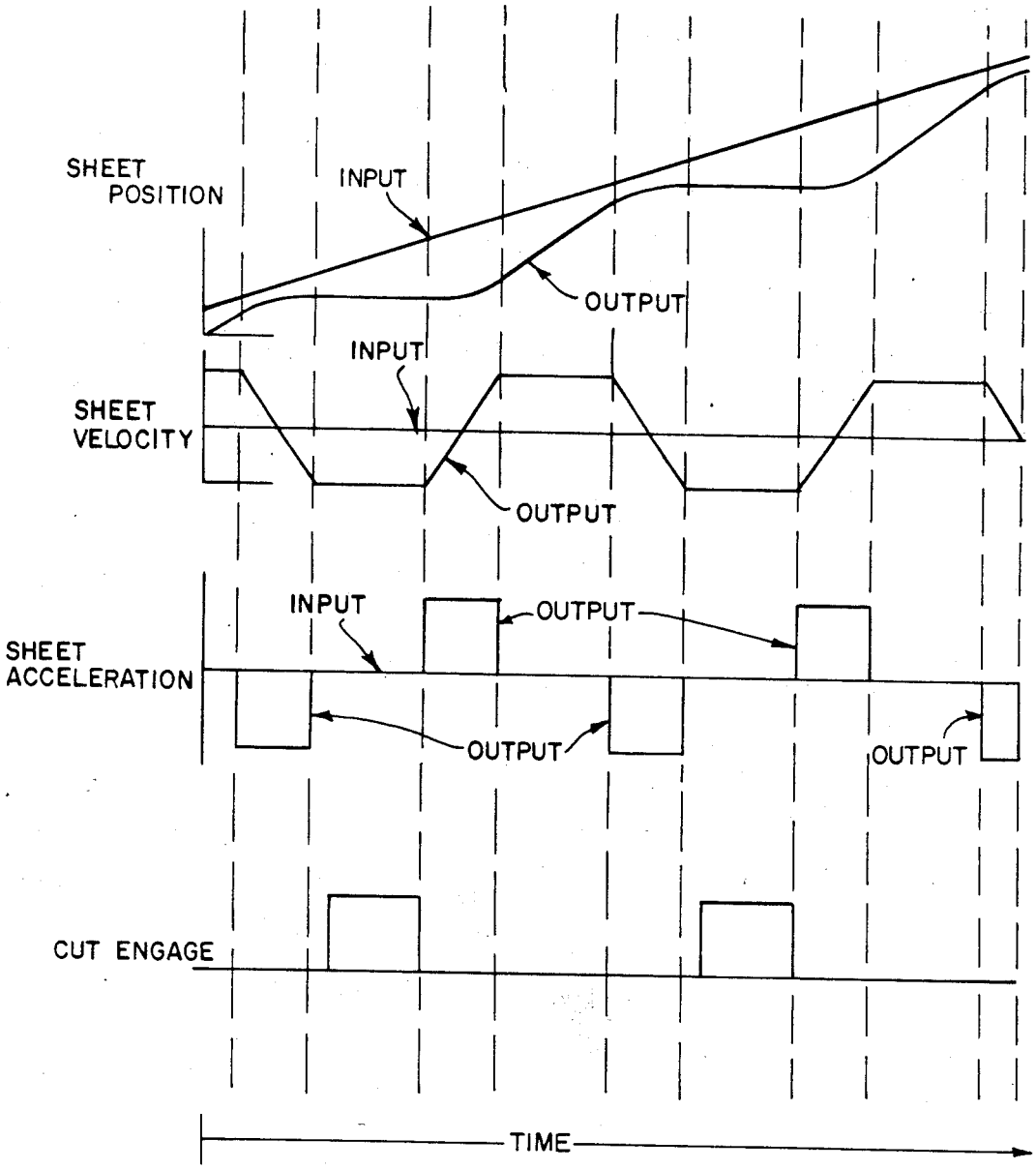
Figure 3C:
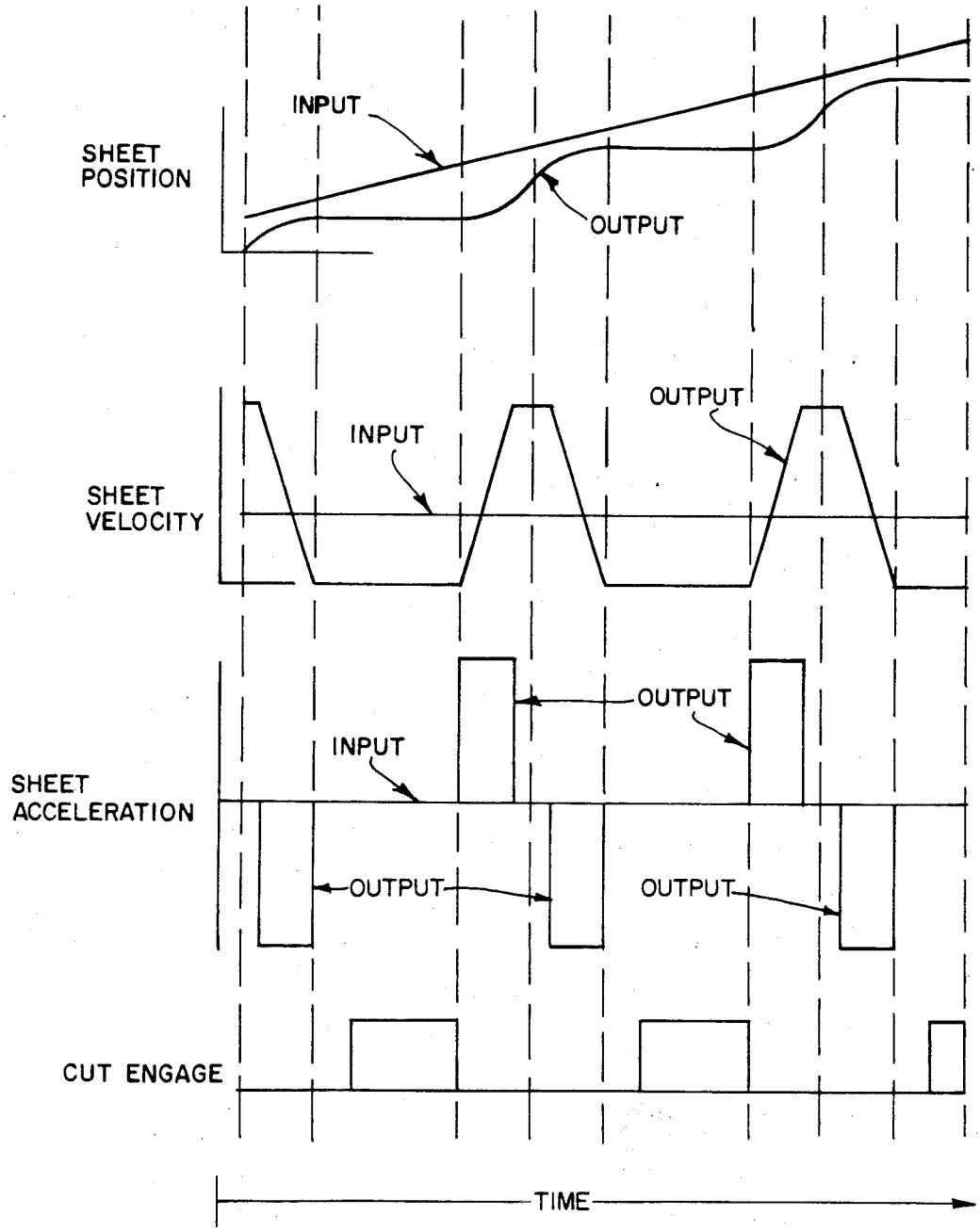

Referring particularly to FIGS. 3A–3C, the position control 9 may be programmed to feed the sheet material 1 to the work station 5 in a number of ways. In FIG. 3A, for example, a sequence is shown in which the sheet material 1 is fed into the work station 5, brought to a stop, cut, and then reaccelerated. The operation of the motion converter 15 is particularly apparent from comparison of motion converter input velocity to output velocity. The input velocity is relatively constant at the pay out rate from the roll 1, whereas the output velocity is brought to zero for the machining operation and then accelerated to a higher velocity after the operation.

In FIG. 3B, a sequence is shown for continuous operation. Again, the sheet material velocity is brought to near zero, the machining operation is enabled, and the sheet is accelerated to feed additional material into the work station 5. In 3C, the same sequence is shown, but the length of each sheet fed into the work station 5 is less than that shown in the sequence of FIG. 3B. It should be apparent, therefore, that the input feedrate, or velocity, may be altered, the length of each piece fed into the work station may be altered, and the cycle rate may be altered to meet any particular requirements. These parameters are manually input to the position control 9 through the control panel 12 to program the desired sequence.

Figure 5:
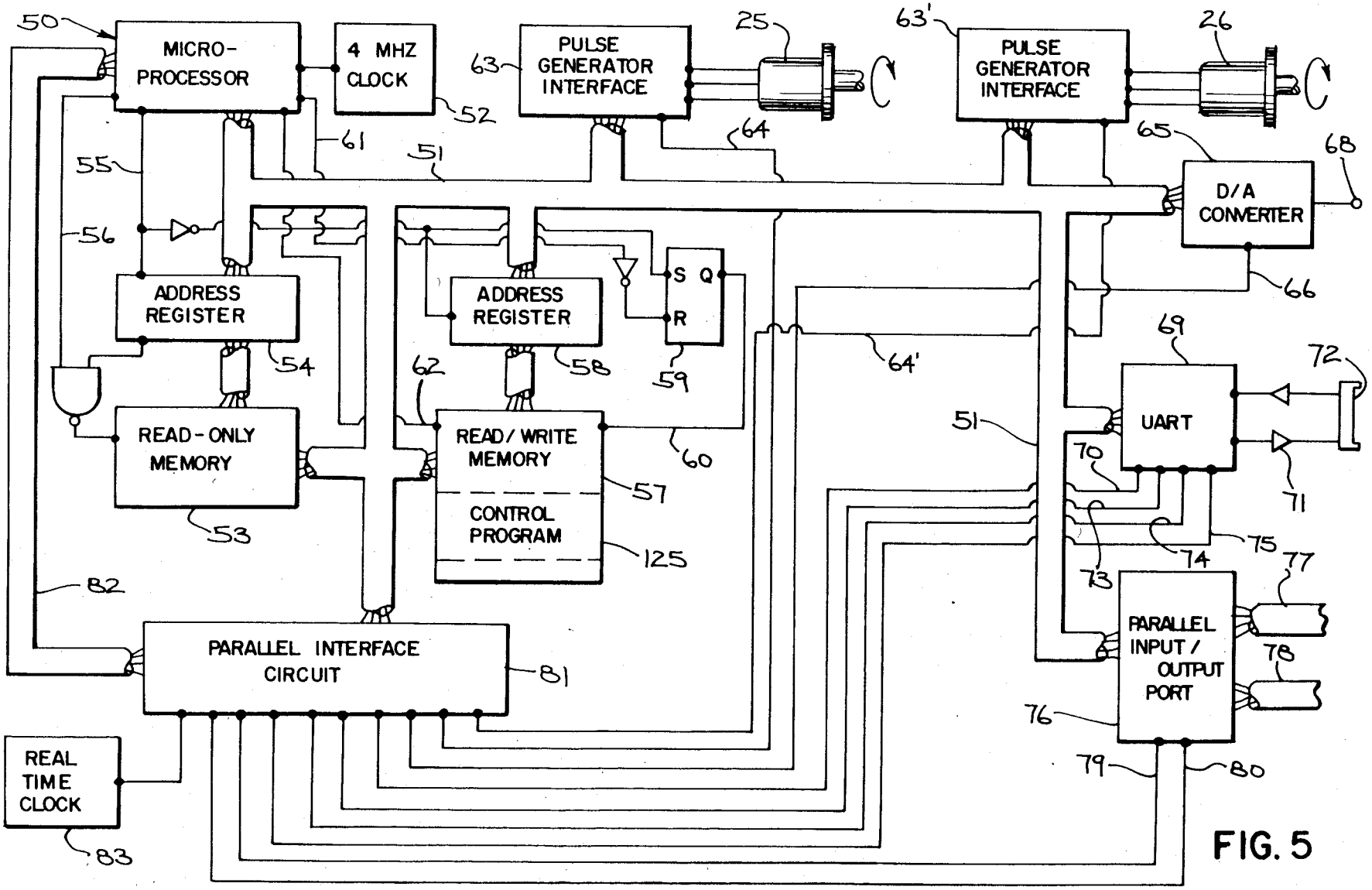
FIG. 5 is an electrical block diagram of the control system which forms part of the system of FIG. 2.

Referring particularly to FIG. 5, the position control circuit 9 is structured around a CMOS 12-bit microprocessor 50 which is manufactured by Intersil, Inc. as part number IM6100. The microprocessor 50 is coupled to the other elements of the position control system through a 12-bit bus 51 and a set of control lines. The microprocessor 50 is driven with a 4 megahertz clock 52 and it operates in response to 12-bit instructions which are stored in a read-only memory 53. Such an instruction is fetched by generating a memory address on the bus 51 which is then latched in an address register 54 when an LXMAR control line 55 becomes active. This latched address is applied to the read-only memory 53, and when a CPSEL control line 56 then becomes active, the instruction at the address in the read-only memory 53 is read out onto the bus 51 and into the instruction register of the microprocessor 50.

The data which is operated upon by the microprocessor 50 is stored in a read/write memory 57. The address terminals of the read/write memory are coupled to the bus 51 through an address register 58, and when the LXMAR control line 55 becomes active during a memory read or write operation, an address is latched in the register 58 and applied to these terminals. Simultaneously, an RS flip-flop 59 is set by the active LXMAR control line 55 to generate a memory read state on a read/write control line 60. An XTC control line 61 also becomes active and when data is to be written to the memory 5, the flip-flop 59 is reset to generate a write signal on the control line 60. The memory 57 is enabled by a MEMSEL control line 62 and data is either read out of the memory 57 onto the bus 51 or written into the addressed memory location.

The microprocessor 50 executes instructions stored in the read-only memory 53 to input data from various source devices, perform calculations on such data, and output the results to various dettination devices. One of the sources of data is a pulse generator interface circuit 63 which connects to the bus 51 and which receives electronic pulses from the pulse generator 25. Each pulse represents an increment of distance and these are accumulated in a bidirectional counter (not shown in the drawings). The counter is incremented when the pulse generator rotates in one direction and is decremented when rotated in the reverse direction. The accumulated count is read onto the bus 51 as a 12-bit binary number when an MPG control line 64 becomes active. By periodically reading in data from the pulse generator interface 63, the position control 9 maintains an accurate indication of the distance the fabricating material moves, its velocity and its acceleration at the input of the motion converter 15. A similar pulse generator interface circuit 63' couples the pulse generator 26 to the position control 9 so that the same information may be obtained at the output of the motion converter 15. The position feedback loop formed by the feedback information from the pulse generators 25 and 26 is closed every 5.5 milliseconds.

Referring still to FIG. 5, the position control 9 drives the amplifiers 19 with an analog command signal that represents the desired magnetic field strength. This signal is generated by a 12-bit digital-to-analog converter circuit 65 which has its inputs connected to the bus 51. When an OUT DAC control line 66 becomes active a 12-bit binary number is written to the D/A converter circuit 65 which generates the corresponding analog signal on an output line 68 to the amplifiers 19.

Communications with the programming panel 12 is accomplished through a universal asynchronous receiver/transmitter (UART) 69 which has its data terminals connected to the bus 51. When an OUT XMR control line 70 is active, an eight-bit data byte is written into the UART 69 and is transmitted serially through an output buffer 71 to a connector 72. When the transmission is complete, an XMR FLG control line 73 is driven low by the UART 69. The connector 72 connects with the serial data link 13 leading to the programming panel. An RS232C protocol is implemented, and thus, a wide variety of commercially available terminals and printers may be employed as the programming panel 12.

When a byte of data is received by the UART 69 from the programming panel 12, an RCR FLG control line 74 is driven high. The microprocessor 50 is programmed to respond by driving an INPUT RCR control line 75 active and to read the received byte from the UART 69. The communication with the programming panel 12 is thus under the control of the microprocessor 50.

A parallel input/output port 76 connects to the bus 51 to drive a 12-bit output bus 77 and receive data from a 12-bit input bus 78. The bus 78 connects through appropriate interface circuits (not shown in the drawnngs) to input devices such as limit switches and control panel switches on the machinery associated with the work station 5. Similarly, the output bus 77 connects to drive operating devices such as solenoids and motor starters on the work station machinery. In this manner, the operation of the system is coordinated with the operation of other machinery in the fabricating system. A 12-bit data word is read from the parallel input port 76 when an INPUT PORT control line 79 is active, and a 12-bit data word is written to the output port 76 when an OUT PORT control line 80 is active. One of these bits is applied to the amplifiers 19 and it indicates whether the upper section 16 or the lower section 17 of the motion converter 15 is energized.

Referring still to FIG. 5, the control lines which activate the above-described input and output circuits are driven by a parallel interface circuit 81. The parallel interface circuit 81 is comprised of three IM6101 parallel interface elements manufactured by Intersil, Inc. These devices provide a universal means for interfacing peripheral equipment and circuits with the IM6100 microprocessor 50. The parallel interface circuit 81 is connected to the microprocessor 50 through a number of control lines, which are indicated collectively as control bus 82. The parallel interface circuit 81 is operable in response to the input/output transfer instructions (IOT) generated by the microprocessor 50 to activate any one of the above-described control lines leading to the input and output circuits. In addttion, it is responsive to the signals on the RCR FLG and XMR FLG control lines 73 and 74 to set internal flags and it is responsive to an interrupt request signal generated by a real time clock 83 to request an interrupt from the microprocessor 50. When an interrupt is then granted, the parallel interface circuit 81 generates the address vector needed to locate the proper interrupt service routine in the read-only memory 53.

The detailed operation of the microprocessor 50, and the manner in which it functions with the parallel interface circuit 81 and memories 53 and 57 is described in the Intersil, Inc. publication "Intersil IM6100 CMOS 12 Bit Microprocessor."

Referring particularly to FIG. 5, the position control operates the amplifiers 19 in response to commands which form part of a control program 125 stored in the read/write memory 57. The creation of this control program 125 as well as its execution is performed by the microprocessor 50 under the direction of machine language instructions stored in the read-only memory 53. These machine language instructions are formed into two main programs; a foreground program which is executed every 5.5 milliseconds, and a background program.

Figure 4A:
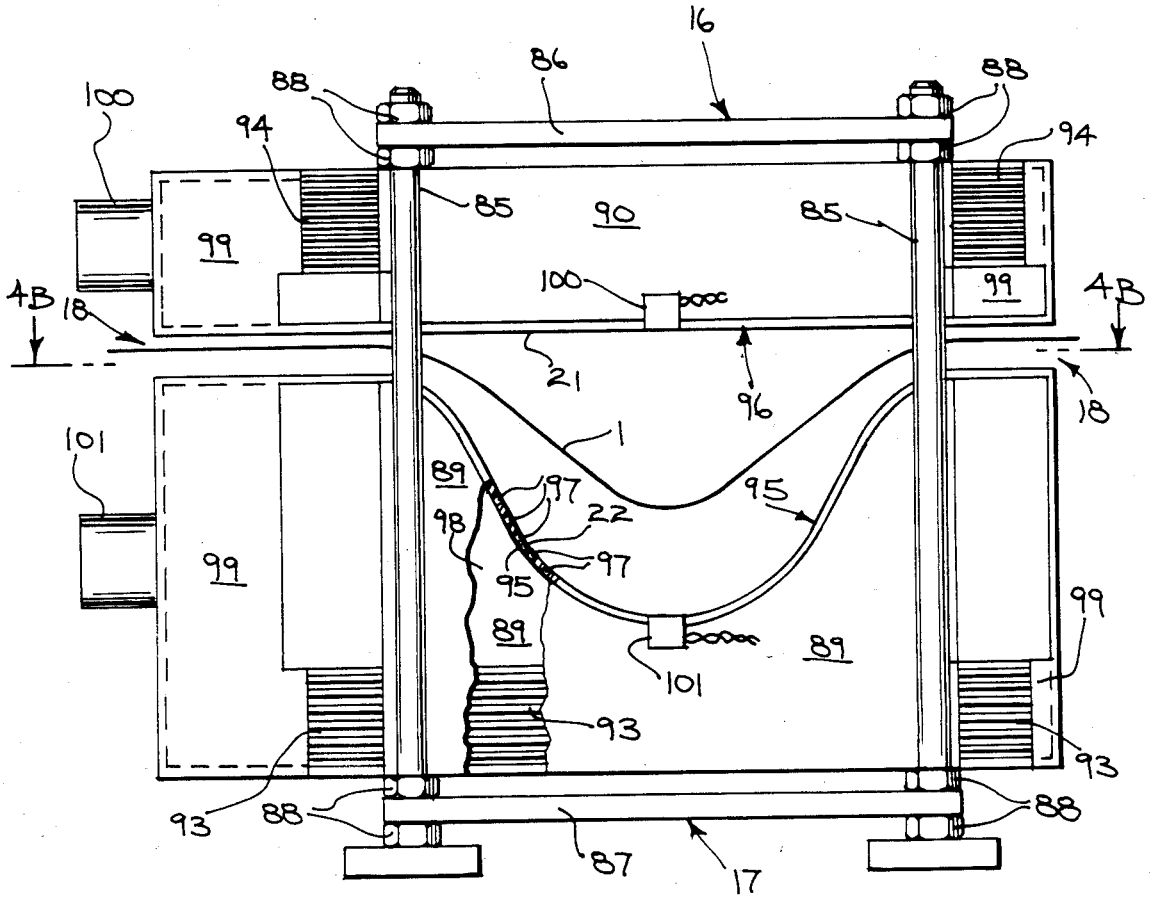
FIG. 4A is a side elevation view of the motion converter in FIG. 2 with parts cut away.
Figure 4B:
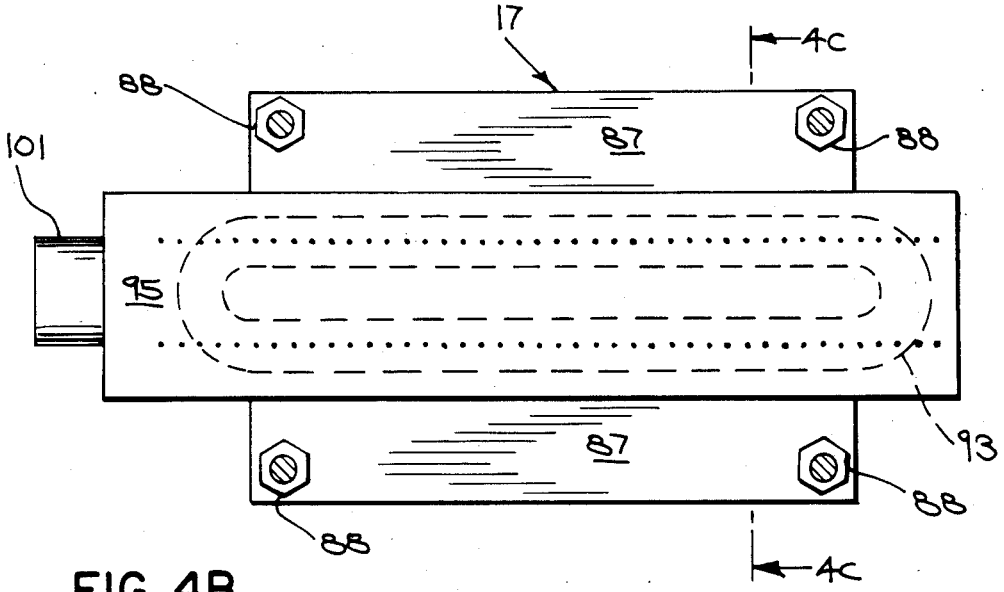
FIG. 4B is a cross section view taken along the plane 4B–4B indicated in FIG. 4A.
Figure 4C:
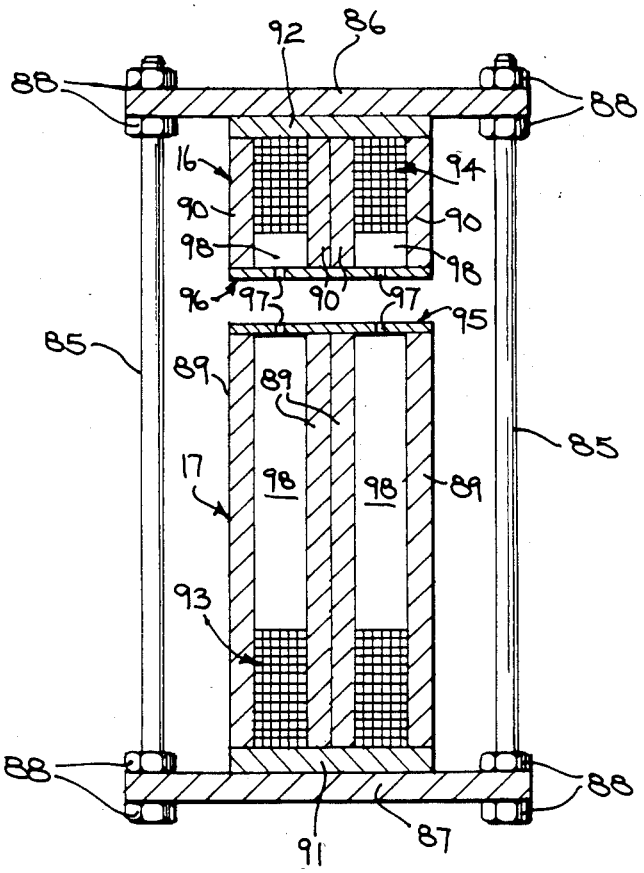
FIG. 4C is a cross section view taken along the plane 4C–4C indicated in FIG. 4B.

Referring particularly to FIGS. 4A-4C, the preferred embodiment of the motion converter includes the upper actuator 16 and the lower actuator 17 which are fastened together by four bolts 85. The bolts 85 not only rigidly fasten the two actuators 16 and 17, but also enable their spacing to be adjusted to control the height of the feedpath 18. The bolts 85 fasten to upper and lower flanges 86 and 87 on the actuators 16 and 17 and nuts 88 enable their spacing to be adjusted and then tightened.

As shown best in FIG. 4C, each actuator 16 and 17 is constructed in a similar manner. A magnetic circuit is formed by four upright steel plates 89 and 90 which are attached to respective flanges 87 and 86 by steel base plates 91 and 92. Two of the steel plates 89 and 90 form central cores, around which electrical coils 93 and 94 are wound. The upper edges of the lower plates 89 are covered with a nonmagnetic stainless steel bearing plate 95 and the lower edges of the upper plates 90 are covered with a stainless steel bearing plate 96. The steel plates 89 and 90 are preferrably formed by thin sheets of steel which are laminated together to reduce eddy current losses.

As shown best in FIGS. 4B and 4C, two rows of air holes 97 are formed in each bearing plate 95 and 96. The rows of holes communicate with air plenums 98 which are formed between the spaced upright steel plates 89 and 90. As shown best in FIG. 4A, these air plenums extend the entire length of the actuators 16 and 17 and communicate with airtight compartments 99 formed at each end. Blowers 100 and 101 are mounted to the left hand compartments 99 of the respective upper and lower actuators 16 and 17, and these pressurize the plenums 98 to force air through the air holes 97. This air forms an air bearing which cushions the sheet material 1 and prevents it from abrasively contacting the upper surface 21 and the lower surface 22 as it is propelled through the feedpath 18. While the air bearings are much preferred, other low friction bearing surfaces may also be employed.

While primary control of the motion converter 15 employs position feedback signals from the incremental position feedback devices 25 and 26 located at the input and output of the motion converter 15, other feedback devices may also be employed. As shown in FIG. 4A, sensors 100 and 101 are mounted in the respective upper and lower actuators 16 and 17 at their midpoint. These sensors 100 and 101 provide a signal to the position control 9 which indicates the distance between the sensor 100 or 101 and the sheet material 1. The sensors ma employ light, ultrasound, or magnetic fields as a means for making the measurement and producing the feedback signal.

Many variations are possible in the preferred embodiment without departing from the spirit of the invention. For example, one of the actuators must have a contoured surface which enables the sheet material to assume a serpentine path when the electromagnet in that actuator is energized. While the other actuator preferrably has a flat surface, this is not necessary. Also, it is preferred that the second actuator have a separately operable electromagnet, but this is not necessary in all applications. For example, the contoured actuator may be located above the sheet material 1 to pull it upward into a serpentine path when its electromagnet is energized. When this electromagnet is deenergized, the sheet material is allowed to fall back toward a straight line path through the motion converter. The precise shape of the lower actuator in this example is not important nor is an electromagnet absolutely required in the lower actuator. This embodiment is particularly applicable where a linear motor such as that shown in FIG. 1 and described in U.S. Pat. No. 4,491,777 is employed at the output of the motion converter to pull the sheet material 1 out the exit and into the work station 5.

I claim:

1. A motion converter for sheet material which comprises:

a pair of actuators which are spaced apart to define a feedpath therebetween through which the sheet material passes, one of said actuators having a contoured surface which enables the sheet material to follow a serpentine path through the motion converter;

an electromagnet disposed in said one actuator to produce a magnetic field when energized which attracts the sheet material towards the contoured surface; and a position control which cyclically energizes the electromagnet to thereby cyclically accumulate sheet material in the motion converter and to thereby convert the motion of the sheet material fed into the motion converter into a different motion.

2. The motion converter as recited in claim 1 in which a second electromagnet is disposed in said other actuator, and the position control cyllically energizes the second electromagnet when the first electromagnet is deenergized.

3. The motion converter as recited in claim 1 in which openings are formed in the contoured surface of said one actuator and means for providing air pressure is coupled to the openings and an air bearing is provided between the contoured surface and the sheet material.

4. The motion converter as recited in claim 1 in which the other actuator has a substantially flat surface and a second electromagnet is disposed therein and is cyclically energized by the position control to produce a magnetic field which attracts the sheet material toward the substantially flat surface and to thereby straighten the path of the sheet material through the motion converter.

5. The motion converter as recited in claim 4 in which the first and second electromagnets are alternately energized by the position control to alternately slow and then speed up the rate at which sheet material exits the motion converter.

6. The motion converter as recited in claim 1 in which a position sensor is coupled to the position control and mounted to sense the position of the sheet material flowing through the motion converter, and the position control is responsive to a feedback signal produced by the position control and a stored position command to control the energization of the electromagnet.

* * * * *